US006145579A

United States Patent [19]

Stagge et al.

[11] Patent Number: 6,145,579

[45] Date of Patent: Nov. 14, 2000

[54] LIQUID-COOLED MOULD

[75] Inventors: Wolfgang Stagge; Gerhard Hugenschütt, both of Belm; Franz Keiser, Ostercappeln, all of Germany

[73] Assignee: KM Europa Metal AG, Osnabruck, Germany

[21] Appl. No.: 09/180,695

[22] PCT Filed: May 7, 1997

[86] PCT No.: PCT/DE97/00961

§ 371 Date: Nov. 13, 1998

§ 102(e) Date: Nov. 13, 1998

[87] PCT Pub. No.: WO97/43063

PCT Pub. Date: Nov. 20, 1997

[30] Foreign Application Priority Data

May 13, 1996 [DE] Germany ..... 196 19 073
Apr. 21, 1997 [DE] Germany ..... 197 16 450

[51] Int. Cl.[7] ..... B22D 11/04

[52] U.S. Cl. ..... 164/418; 164/459

[58] Field of Search ..... 164/418, 459

[56] References Cited

U.S. PATENT DOCUMENTS 4,834,167 5/1989 Streubel ..... 164/418

FOREIGN PATENT DOCUMENTS 3-258440 11/1991 Japan ..... 164/418
60-49834 11/1991 Japan ..... 164/418

*Primary Examiner*—Kuang Y. Lin
*Attorney, Agent, or Firm*—Kenyon & Kenyon

[57] ABSTRACT

A liquid-cooled chill mold for continuous casting of thin steel slabs is disclosed whose cross-sectional length is a multiple of the cross-sectional width, having two opposing wide side walls, each with a copper liner and a backing plate, and narrow side walls delimiting the width of the slab, with the copper liners that delimit the mold cavity being detachably attached to the backing plates by metal studs made of a CuNiFe alloy and the metal studs being welded to the copper liners.

11 Claims, 3 Drawing Sheets

LIQUID-COOLED MOULD

FIELD OF THE INVENTION

The present invention is directed to a liquid-cooled chill mold that is used for continuous casting of thin steel slabs whose cross-sectional length is a multiple of its cross-sectional width.

BACKGROUND OF THE INVENTION

A liquid-cooled chill mold of the type in question is used for continuous casting of thin steel slabs whose cross-sectional length is a multiple of its cross-sectional width. At least each wide side wall is composed of a copper liner bordering the mold cavity and a steel backing plate. The copper liner is attached to the backing plate by metal studs projecting laterally. The metal studs therefore pass through bore holes in the backing plate. At the ends of the bore holes are enlarged areas where nuts can be screwed onto the threaded ends of the metal studs. With their help the copper liner is tightened against the backing plate.

Within the scope of U.S. Pat. No. 3,709,286, it is known that the metal studs may be made of stainless steel. However, metal studs made of stainless steel yield poor welded joints with the copper liner because coarse-grained structures develop at the welds, which have a low elasticity and therefore are very sensitive to flexural stresses.

From the Patent Abstracts of Japan JP-A 3258440, it is known that threaded bushings can be inserted into rear bore holes in the copper liner bordering the chill mold space, and longer rods passing laterally through a cooling box can be screwed into these bushings, and the copper liner tightened against the stainless steel backing plate. To do so, bore holes are also provided in the backing plate. In addition, short fastening studs are attached to the rear side of the copper liner by stud welding. These sort fastening studs are provided with bushings into which the rods passing through the cooling box can be screwed.

Against the background of this related art, the object of the present invention is to create a liquid-cooled chill mold for high casting rates, in particular for continuous steel casting in close-to-final dimensions, with a great reduction in strength problems in areas where the metal studs are joined to the copper liners.

SUMMARY OF THE INVENTION

The object of the present invention is achieved with a liquid-cooled chill mold for continuous casting of thin steel slabs whose cross-sectional length is a multiple of the cross-sectional width, having two opposing wide side walls, each with a copper liner and a backing plate, and narrow side walls delimiting the width of the slab, with the copper liners that delimit the mold cavity being detachably attached to the backing plates by metal studs made of a CuNiFe alloy and the metal studs being welded to the copper liners.

At the core of the present invention is the measure of producing the metal studs specifically of a CuNiFe alloy. Because of such metal studs, in particular hard-drawn metal studs, a considerable increase in strength is achieved with only a narrow scattering in strength in the welded joints with the copper liner. The latter may be made of pure copper, e.g., SF—Cu (oxygen-free copper ASTM C12200), or a copper alloy with a high temperature stability, e.g., a hardenable copper alloy containing chromium and/or zirconium additives. This eliminates the previously unreliable handling and the many influencing factors during welding which entail 100% testing.

In an especially advantageous embodiment, the metal studs are made of a CuNi30Mn1Fe material.

To attach the metal studs to the copper liners, the essentially known stud welding method is used to advantage.

To improve the strength and toughness of the welded joint, the metal studs are welded to the copper liners using a filler material.

Nickel is used in particular as a filler material here. The filler material may be applied as a thin plate between the metal studs and copper liners. It is likewise possible to provide the copper liners with filler material at the connecting points or to plate the end faces of the metal studs. Furthermore, it is possible to use nickel rings around the periphery of the metal studs as filler material.

In another embodiment of the basic idea of the present invention, copper liners for the wide side walls have groove-like coolant channels running parallel to the casting direction and covered by the backing plates. With the help of such coolant channels, an increased transfer of heat from the casting side to the cooling water can be guaranteed, so that high casting rates can be achieved. Cracking in the copper liners and damage to any surface coatings that might be present are eliminated. Coolant channels in the copper liners are used in particular when the copper liner is thick enough to allow coolant channels with a sufficiently large cross section to be formed.

To also dissipate heat intensively in the area of the metal studs, the copper liners have cooling holes running next to the coolant channels and parallel to the casting direction, extending in the vertical cross-sectional planes of the metal studs. Such cooling holes can be produced by mechanical drilling. Coolant transferred through these cooling holes prevents a local rise in temperature in the copper liners around areas where the metal studs are connected to the copper liner in the continuous casting operation.

The cooling bores are preferably arranged in the area of the bath level.

When using thin copper liners which guarantee a very good heat transfer, the present invention proposes that the backing plates have groove-like coolant channels running parallel to the casting direction and covered by the copper liners. Then no coolant channels are provided in the copper liners. A combination of coolant channels in the copper liners and in the backing plates may optionally also be used.

To further increase the casting rate, the cross section of the mold cavity is designed with larger dimensions at the pouring end than at the outlet end.

In this connection, it is also advantageous if the mold cavity has a multiple conicity.

As used herein, the phrase multiple conicity refers to a mold having sidewalls with different tapers in different sections of the mold. In order to achieve optimal solidifying conditions for the molten metal in the chill molds, the chill molds must be conically tapered in the casting direction due to the shrinkage of the casting shell upon its formation. In this case, the conicity is a function of the speed and the type of the steel to be cast. Instead of the customary linear conicity used up to this point, chill-mold geometries having two-stage, three-stage, multi-stage, or parabolic conicities are now used in adjusting to the shrinkage of the respective steel melt. If three length sections of the chill mold cavity, e.g. the pour-in area, the middle, and the extrusion outlet, each have different degrees of conicity, this is referred to as three-stage conicity.

Finally, a flared end tapering in the casting direction may be provided on the pouring end of the mold cavity. This flare serves to accommodate a submerged tube in particular.

BRIEF DESCRIPTION OF THE DRAWINGS

The present invention is described in greater detail below on the basis of embodiments illustrated in the drawings, which show.

DETAILED DESCRIPTION

Figure 1:
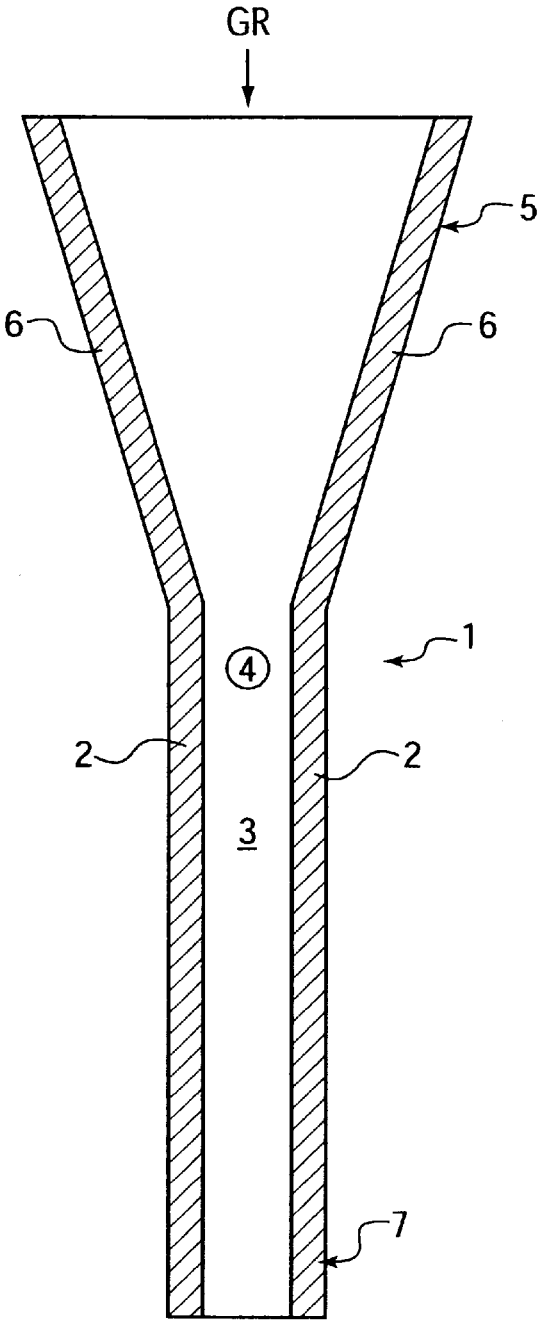
FIG. 1 shows a diagram of a vertical longitudinal section through a liquid-cooled chill mold.

FIG. 1 shows a liquid-cooled chill mold 1, which is illustrated only in diagram form, for continuous casting of thin steel slabs (not shown) whose cross-sectional length is a multiple of its cross-sectional width. Chill mold 1 has two opposite multilayer wide side walls 2 and two narrow side walls 3, also opposing one another, forming mold cavity 4.

On pouring end 5 of mold cavity 4, wide side walls 2 are provided with flared sections 6 which taper smoothly toward the bottom along part of the height of chill mold 1. The cross section of mold cavity 4 is rectangular at slab discharge end 7 and is based on the desired cross section of the thin slab. The purpose of the two opposing flared sections 6 is to create space required for a submerged tube (not shown) for supplying the molten metal.

Figure 2:
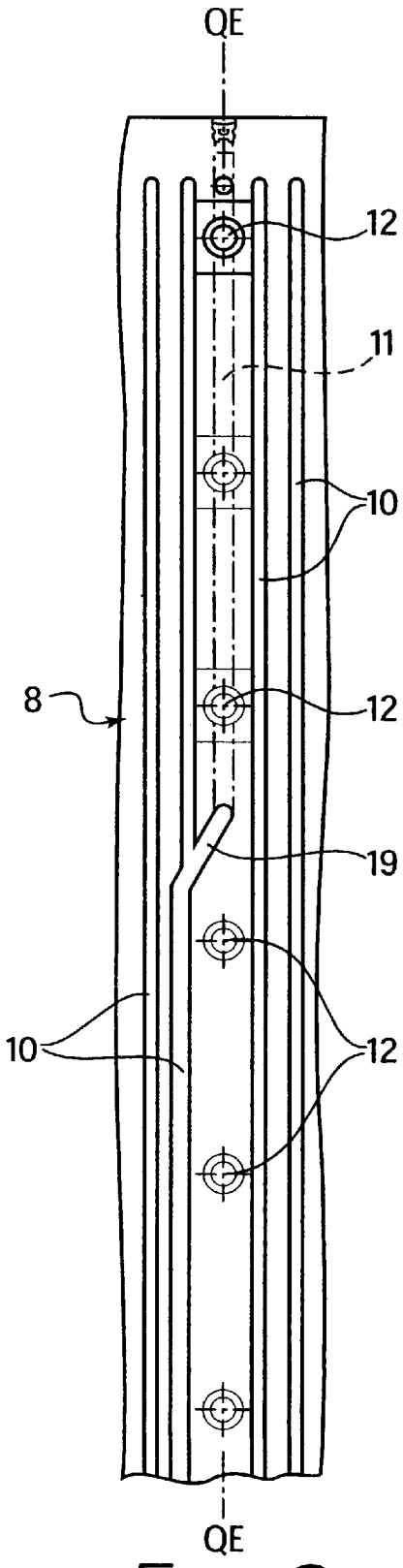
FIG. 2 shows an enlarged partial view of the back side of a copper liner of the chill mold in FIG. 1 according to arrow II in FIG. 3.
Figure 3:
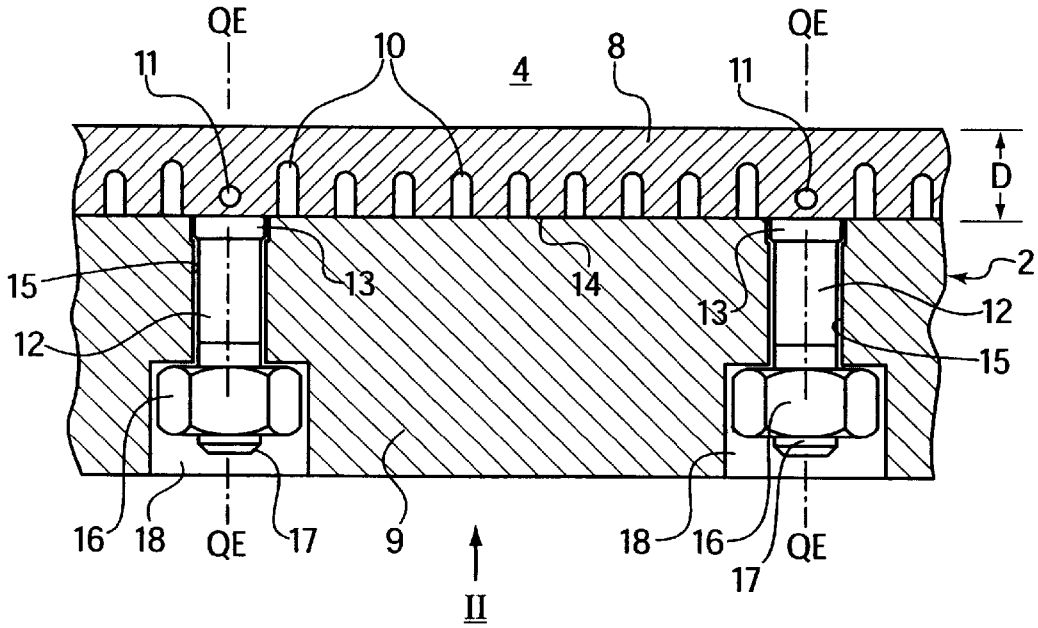
FIG. 3 shows a partial horizontal section through a wide side wall of the chill mold in FIG. 1 on an enlarged scale.

As FIG. 3 also shows, each wide side wall 2 has a copper liner 8 bordering mold cavity 4 and a steel backing plate 9. Groove-like coolant channels 10, which can be supplied with cool water, run parallel to casting direction GR, and are covered by backing plate 9, are provided in copper liner 8, as also indicated in FIG. 2, which does not show backing plate 9.

In addition, FIGS. 2 and 3 show that cooling holes 11 which can also receive cooling water run parallel to coolant channels 10. Cooling bores 11 run in vertical cross-sectional planes QE of metal studs 12 made of CuNi30Mn1Fe, which are attached to rear side 14 of copper liner 8 by the stud welding method using nickel rings 13 as filler material. Metal studs 12 pass through bore holes 15 in backing plate 9. By screwing nuts 16 onto threaded ends 17 of metal studs 12, copper liner 8 is tightened onto backing plate 9 and secured there. Nuts 16 sit in enlarged end sections 18 of bore holes 15.

Coolant is supplied to cooling holes 11 through coolant channels 10, expediently through a branch 19 between a cooling hole 11 and adjacent coolant channel 10, as shown in FIG. 2.

FIG. 3 also shows that coolant channels 10 next to cross-sectional planes QE of metal studs 12 are deeper than the other coolant channels 10.

Coolant channels 10 and cooling holes 11 are arranged in a copper liner 8 if copper liner 8 has a sufficient thickness D.

Figure 4:
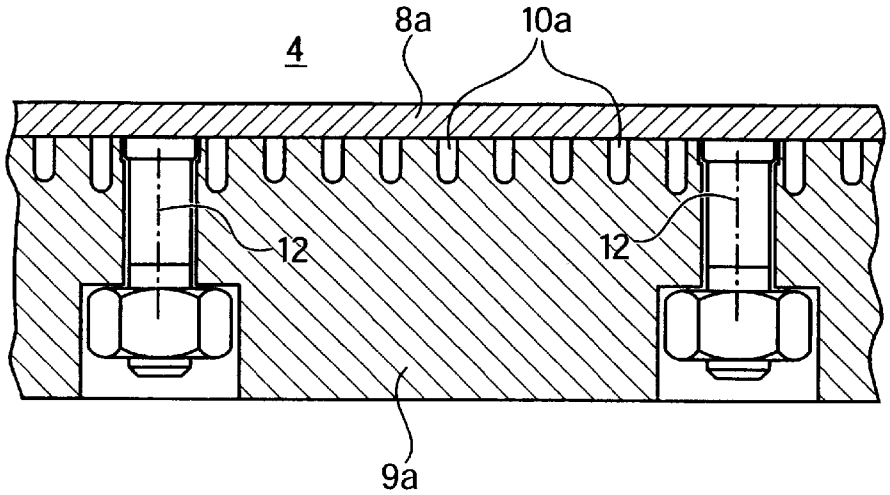
FIG. 4 shows a partial horizontal section through a wide side wall according to another embodiment, also on an enlarged scale.
Figure 5:
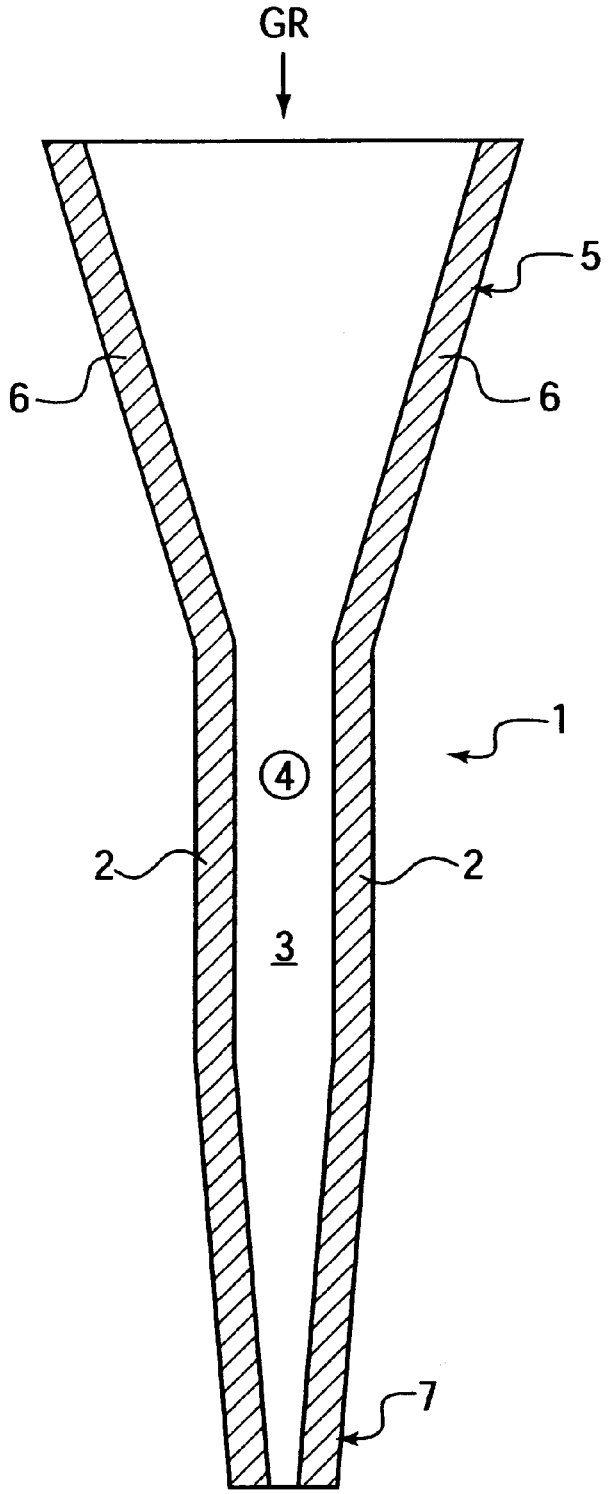
FIG. 5: a diagram of a vertical longitudinal section through a liquid-cooled chill mold with multiple conicity.

However, if a thinner copper liner 8*a* is used, coolant channels 10*a* are incorporated into backing plate 9*a* according to FIG. 4 and are covered by copper liner 8*a* as copper liner 8*a* is secured to backing plate 9*a* with metal studs 12.

What is claimed is:

1. A liquid-cooled chill mold for continuous casting of thin steel slabs whose cross-sectional length is a multiple of the cross-sectional width, having two opposing wide side walls, each with a copper liner and a backing plate, and narrow side walls delimiting the width of the slab, with the copper liners that delimit the mold cavity being detachably attached to the backing plates by metal studs made of a CuNi30Mn1Fe alloy and the metal studs being welded to the copper liners.

2. The chill mold according to claim 1, characterized in that the metal studs are attached to the copper liners by stud welding methods.

3. The chill mold according to claim 1, characterized in that the metal studs are welded to the copper liners using a filler material.

4. The chill mold according to claim 3, characterized in that the filler material is nickel.

5. The chill mold according to claim 1, characterized in that the copper liners of the wide side walls have groove-like coolant channels running parallel to the direction of casting and covered by the backing plates.

6. The chill mold according to claim 1, characterized in that the copper liners have cooling holes running parallel to the casting direction in addition to the coolant channels and extending in the vertical cross-sectional planes of the metal studs.

7. The chill mold according to claim 6, characterized in that the cooling holes are arranged in the area of the bath level.

8. The chill mold according to claim 1, characterized in that the backing plates have groove-like coolant channels running parallel to the casting direction and covered by the copper liners.

9. The chill mold according to claim 1, characterized in that the cross section of the mold cavity is larger at the pouring end than at the slab discharge end.

10. The chill mold according to claim 1, characterized in that the mold cavity has a multiple conicity.

11. The chill mold according to claim 1, characterized in that the mold cavity has at least one flared section at the pouring end, tapering in the casting direction.

* * * * *